United States Patent [19]

Martin

[11] 3,970,529

[45] July 20, 1976

[54] ELECTROPOLISHING ALUMINUM AND ALUMINUM ALLOYS

[75] Inventor: Sylvia Martin, Detroit, Mich.

[73] Assignee: Oxy Metal Industries Corporation, Warren, Mich.

[22] Filed: Apr. 30, 1975

[21] Appl. No.: 573,186

[52] U.S. Cl. ..... 204/129.9; 204/129.95

[51] Int. Cl.[2] ..... C25F 3/00

[58] Field of Search ..... 204/129.9, 129.95

[56] References Cited

UNITED STATES PATENTS

| | | | |
|---|---|---|---|
| 2,461,035 | 2/1949 | Clingan | 204/129.9 |
| 2,708,655 | 5/1955 | Turner | 204/129.9 |
| 3,119,726 | 1/1964 | King et al. | 204/129.9 |
| 3,627,654 | 12/1971 | Petit et al. | 204/129.9 |

*Primary Examiner*—T. M. Tufariello

*Attorney, Agent, or Firm*—B. F. Claeboe

[57] ABSTRACT

A process and bath for electropolishing and brightening aluminum and aluminum alloys. The bath preferably contains from about 30 percent to about 95 percent phosphoric acid and from about five percent to about 70 percent of a poly (alkylene ether). A minor amount, generally from about 0.05 to about two percent, of a wetting agent may be added to the bath if desired. The bath forms a protective foamy film over the part being electroplated, thereby protecting the part against chemical attack by the bath. Further, the polyether additives are chemically and thermally stable in the electrolyte under normal bath operating conditions. The bath may be operated at low voltages ranging from about 15 to 100 volts.

8 Claims, No Drawings

ELECTROPOLISHING ALUMINUM AND ALUMINUM ALLOYS

BACKGROUND OF THE INVENTION

The present invention is directed to the electropolishing of aluminum and aluminum alloys. The electrobrightening and the electropolishing of aluminum and aluminum alloys are essentially selective-dissolution processes, in which the high points of the rough surface are attacked more rapidly than the depressions. In essence, these processes remove a surface skin of metal, thereby substantially entirely preventing any contamination of the surface skin with oxides of the base metal or with traces of residual inclusions, such as polishing and buffing compounds, while at the same time brightening the surface.

The prior art processes for electrobrightening of aluminum include the so-called Battelle process, which utilizes a mixture of 95% by volume phosphoric acid, five percent by volume sulphuric acid, and 12.5 grams per liter of chromic acid.

Another process reported in the literature (Aluminum, Vol. III, Fabrication and Finishing, American Society of Metals, 1967 edition, pgs. 634 and 635) utilizes an electrolyte containing 62.5% by volume phosphoric acid, and 37.5% by volume ethylene glycol monoethyl ether. This process is utilized for deburring applications, as well as for electrobrightening.

In all of these prior art brightening and deburring processes, the strongly acid electrolyte tends to attack the metal, thereby pitting the metal and reducing its brightness. Further, the ether compound utilized in the second composition above defined is volatile at the operating temperatures of the bath, which range from 170° to 185°F. The attack of the acid electrolyte on the aluminum being polished, is, of course, increased where appreciable amounts of other alloy metals are incorporated into the aluminum. For example, recently developed aluminum bumper alloys containing from about 4 to about 8% zinc may well be excessively attacked by the abovedefined acidic electrolytes.

SUMMARY OF THE INVENTION

It has now been discovered that a markedly and improved process and bath for electropolishing and brightening aluminum and aluminum alloys is obtained from a mixture of phosphoric acid and a poly (alkylene ether) or a substituted poly (alkylene ether) derivative. The polyether forms a foamy film over the part to be electropolished, this film protecting the part from chemical attack by the acidic electrolyte while being polished. The concentrations of the ingredients are widely variable, the effective amounts of phosphoric acid by volume, ranging from about 30% to about 95%, and the amounts of the poly (alkylene ether) reciprocally ranging from about 70% to about 5%. When lower amounts of phosphoric acid are incorporated, ranging downwardly from about 60%, the electropolishing may require a relatively greater period of time, increased voltages, and higher bath operating temperatures.

Preferably, a minor amount of a wetting agent is added to the mixture of acid and polyether. Generally, from about 0.05 to about 2% by volume of a fatty acid polyether formulated compound is added as the wetting agent. The wetting agent addition is not critical, it does, however, prevent any tendency of evolved gas bubbles to adhere to the surface of the part being electropolished.

Bath operating conditions generally include operation at a temperature from about 150° to about 220°. Surprisingly enough, initial current densities ranging from about 30 amperes per square foot to about 150 a.s.f. can be utilized. The possibility of operating at current densities as low as 30 a.s.f. is unusual in view of the practices of the prior art. As the electroplating process proceeds, the current tends to decrease.

DESCRIPTION OF THE PREFERRED EMBODIMENTS

As is the practice in electropolishing or electrobrightening processes, the method of the present invention involves the suspension of the part as the anode in an electrolytic bath having insoluble cathodes, which may be of carbon.

The present invention is particularly directed to the electropolishing of parts made of aluminum or aluminum alloys. Those parts which are composed of substantially pure aluminum plus normal impurities electropolish beautifully by utilization of the method and bath of the present invention.

Other typical aluminum alloys which may be electropolished in accordance with the present invention are located in Table I.

Of particular interest are the alloys 7046 and 7016 which contain from about 4 to almost 8% zinc. These new alloys have been specifically developed for automotive bumpers and are not yet standard alloys in the sense that they are specifically listed in the handbooks. The high percentage of the zinc in these alloys make these alloys particularly susceptible to attack by conventional acidic electropolishing baths of the prior art. Yet, these alloys are polished perfectly and safely by utilization of the bath of the present invention.

TABLE I

| | 7046 | 7016 | 6061 | 6253 | 5657 | 5252 |
|---|---|---|---|---|---|---|
| Si | .4 max | .3 max | 0.4–.8 | — | 0.08 | 0.08 |
| Fe | .35 max | .1 max | 0.7 | 0.1 | 0.1 | 0.1 |
| Cu | .1 (.25 max) | 1. | .15–.4 | — | 0.1 | 0.0 |
| Mn | 0.3 | .03 max | .15 | — | .03 | 0.1 |
| Mg | 1.3 | 1.1 | 1.0 | 1.2 | 0.6–1 | 2.2–2.5 |
| Cr | .12 | — | .2 | .25 | — | — |
| Zn | 6.6–7.6 | 4–5 | .25 | 2.0 | .03 | — |
| Zr | .12 | — | — | — | — | — |
| Ti | 103 | .03 max | .15 | — | — | — |
| Al | balance | balance | balance | balance | balance | balance |

Illustrative examples of other possible alloys include 1100, 3105, 5052, 5154, 6063, 7079, 514.2, 214 and A214.

As above explained, the primary bath ingredients include phosphoric acid ($H_3PO_4$). Preferably, the bath is prepared by the utilization of concentrated phosphoric acid having a specific gravity of 1.70, this grade of phosphoric acid is about 86% $H_3PO_4$ in water solution. The amount of phosphoric acid incorporated into the bath may range from a low of about 30% by volume to a high of about 95% by volume. As is later explained, the amount of phosphoric acid incorporated into the bath has an effect upon the operating conditions of the bath.

The other primary bath ingredient is a poly (alkylene ether) or a derivative of such a polyether, having a molecular weight ranging from about 112 to about 1200. Typically, such poly (alkylene ethers) include polymers of ethylene oxide, propylene oxide, or mixtures thereof. Suitable derivatives include the methyl, ethyl, propyl ethers and the like of either polymer up to hexyl. It is necessary, of course, that the polyether or derivative thereof be a liquid which is soluble in or mixable in the phosphoric acid at the temperatures and under the conditions of the bath.

Preferably, a wetting agent is added to the bath, generally in an amount ranging from about 0.05 to about 2% by volume. Any wetting agent capable of lowering the surface tension on the part to be electropolished, possessed of the ability of eliminating the adherence of gas bubbles on the surface to be treated, and capable of withstanding the strongly acidic media may be effectively utilized. One preferred wetting agent is a fatty acid polyether formulation. Such wetting agents are formed by the reaction of a fatty acid such as oleaic acid, stearic acid or lauryl acid with either polyethylene oxide or polypropylene oxide, the acid being present in an equivalency ratio of one-to-one up to about two-to-one with respect to the polyether.

The presence of the wetting agent is desirable because it prevents adherence of gas bubbles to the surface of the part being electropolished. The same foamy film forms on the part to be electropolished whether or not the wetting agent is present.

Desirable operating conditions for the method of the present invention include operation at temperatures ranging from about 150°F to about 200°F, although this higher temperature may be increased to 220°F or even higher when lower amounts of phosphoric acid, e.g., on the order of from 30 to 60% phosphoric acid, by volume are present in the electrolyte.

Current densities ranging from about 30 to about 150 amperes per square foot are utilized together with voltages at from about 15 to 100 volts. The utilization of current densities in the lower ranges naturally affords substantial operating economies.

Generally, the time of treatment ranges from about three minutes to about five minutes, although the treatment period can be extended for as long as from ten to twenty minutes when lower concentrations of phosphoric acid are utilized. Even these longer periods of treatment do not result in any pitting or chemical attack upon the brightened surface. It has also been found that the baths of the present invention can be maintained at operating temperatures for extended periods of time. For example, after two weeks at a temperature of 185°, no deleterious chemical breakdown products in the bath were produced.

During the operation of the bath, the formation of a foamy film over the part to be electropolished can be visually observed. This film apparently forms by attraction of the polyether ingredient to the anode to protect the part from chemical attack during the polishing operation. The degree of brightening and polishing is such that physical buffing can be reduced or eliminated and smooth, fully bright, aluminum parts result. Typically, in the manufacture of automotive trim parts and the like from aluminum, such as the newly developed bumper alloys 7046 and 7016, the electropolished parts are further anodized for added corrosion protection. The quality of the anodizing treatment and the appearance of the final part is directly related to the efficacy of the electropolishing. The highly brightened and polished parts resulting from their treatment in accordance with the present invention results in a better appearing, uniformly anodized final part.

ELECTROPOLISHING EXAMPLES

EXAMPLE I

To make a liter of solution the following formulation was prepared:

| | |
|---|---|
| 600 ml | concentrated phosphoric acid |
| 400 ml | polyethylene oxide (MW 400) |
| 0.1 % | polypropylene oxide 400-oleate |

Electropolish at 170°F, and 15 volts using carbon cathodes. The product was bright after 3–5 minutes of treatment. The above addition agents formed a foamy film over the aluminum part, so that it was not attacked while being polished.

EXAMPLE II

To make a liter of solution a composition as follows was utilized:

| | |
|---|---|
| 600 ml | concentrated phosphoric acid |
| 400 ml | polypropylene oxide (MW 300) |
| 0.3 % | polyethylene oxide 400 — stearate |

Electropolish at 185°F, and 25 volts. The product was polished for five minutes using insoluble carbon cathodes, producing a bright and smooth surface. The additives protect the aluminum alloy part processed from chemical attack while being polished.

EXAMPLE III

To make a liter of solution there was combined:

| | |
|---|---|
| 500 ml | concentrated phosphoric acid |
| 500 ml | methoxy polyethylene oxide (MW 500) |

Electropolish at 180°F, at 30 volts, using carbon cathodes. The product was bright and more polished after five to ten minutes of treatment and a bright film was apparent uniformly over the part.

Various changes and modifications in the processes and baths of this invention have been disclosed and these and others may of course be practiced without departing from the spirit of the invention or the scope of the subjoined claims.

What is claimed is:

1. In a method of anodically electropolishing articles formed of aluminum and aluminum alloys to obtain a full bright, polish surface, which comprises the steps of:

a. immersing the article as the anode in a bath comprising from about 95% to about 30% by volume concentrated phosphoric acid and from about 5% to about 70% by volume of a polymer selected from the group consisting of poly (alkylene ether) having at least four ether groups and derivatives thereof, and b. operating the bath at a temperature of from about 150° to about 200°F at a current density of from about 30 a.s.f. to about 150 a.s.f. and at about 15 to about 100 volts, until the surface of said article is polished.

2. In a method of electropolishing an article of aluminum or an aluminum alloy by operating a bath with the article as the anode, the improvement wherein the bath consists essentially of from about 95% to about 30% by volume concentrated phosphoric acid, and the balance is a polymer of a compound selected from the group consisting of ethylene oxide, propylene oxide, mixtures of ethylene oxide and propylene oxide, and methyl, ethyl and propyl up to hexyl ethers of such oxides, said polymer having a molecular weight ranging from about 112 to about 1200 and being soluble in the phosphoric acid.

3. In a bath for electropolishing articles formed of aluminum and aluminum alloys, the bath comprising concentrated phosphoric acid, the improvement of incorporating in the bath from about 5% to about 70% of a polymer selected from the group consisting of poly (alkylene ethers) and other ether derivatives thereof.

4. An electrolytic bath for electropolishing an article of aluminum or an aluminum alloy, consisting essentially of from about 95% to about 30% by volume concentrated phosphoric acid, and the balance is a polymer of a compound selected from the group consisting of ethylene oxide, propylene oxide, mixtures of ethylene glycol and propylene glycol, and methyl, ethyl and propyl up to hexyl ethers of such oxides, said polymer having a molecular weight ranging from about 112 to about 1200 and being soluble in the phosphoric acid.

5. In a bath as defined in claim 3, the further improvement of additionally incorporating in said bath from about 0.05 to about 2% of a wetting agent which is a fatty acid polyether formulation.

6. In a bath as defined in claim 4, the further improvement of additional incorporating in said bath from about 0.05 to about 2% of a wetting agent which is a fatty acid polyether formulation.

7. In the method as defined in claim 1, the improvement of additionally incorporating in said bath from about 0.05 to about 2% of a wetting agent which is a fatty acid polyether formulation.

8. In the method as defined in claim 2, the improvement of additionally incorporating in said bath from about 0.05 to about 2% of a wetting agent which is a fatty acid polyether formulation.

* * * * *